US009842502B2

(12) United States Patent
Fries et al.

(10) Patent No.: US 9,842,502 B2
(45) Date of Patent: Dec. 12, 2017

(54) SYSTEMS AND METHODS FOR MAINTAINING INTERLOCKINGS OF TRANSPORTATION NETWORKS

(71) Applicant: Alstom Transport Technologies, Saint-Ouen (FR)

(72) Inventors: Jeffrey Michael Fries, Lee's Summit, MO (US); Jeffrey Keith Baker, Overland Park, KS (US)

(73) Assignee: Alstom Transport Technologies, Saint-Quen (FR)

( * ) Notice: Subject to any disclaimer, the term of this patent is extended or adjusted under 35 U.S.C. 154(b) by 149 days.

(21) Appl. No.: 14/148,864

(22) Filed: Jan. 7, 2014

(65) Prior Publication Data

US 2014/0365102 A1 Dec. 11, 2014

Related U.S. Application Data

(60) Provisional application No. 61/833,166, filed on Jun. 10, 2013.

(51) Int. Cl.

| | |
|---|---|
| ***G08G 1/16*** | (2006.01) |
| ***G08G 1/01*** | (2006.01) |
| ***B61L 27/00*** | (2006.01) |

(52) U.S. Cl.

CPC ..... *G08G 1/164* (2013.01); *B61L 27/0088* (2013.01); *G08G 1/01* (2013.01)

(58) Field of Classification Search

CPC ..... G08G 1/01; G08G 1/164; B61L 27/0088

See application file for complete search history.

(56) References Cited

U.S. PATENT DOCUMENTS

| | | | | |
|---|---|---|---|---|
| 4,361,300 | A * | 11/1982 | Rush | B61L 27/0016 246/187 C |
| 4,361,301 | A * | 11/1982 | Rush | B61L 1/18 104/298 |
| 4,763,267 | A * | 8/1988 | Knight | G06F 11/1633 246/131 |
| 6,308,117 | B1 * | 10/2001 | Ryland | B61L 19/06 246/131 |
| 6,824,110 | B2 | 11/2004 | Kane | |
| 7,089,093 | B2 | 8/2006 | Lacote | |

(Continued)

*Primary Examiner* — Redhwan K Mawari
*Assistant Examiner* — Michael Whalen
(74) *Attorney, Agent, or Firm* — Christopher R. Carroll; The Small Patent Law Group, LLC.

(57) ABSTRACT

A system includes a detection module, a control module, an input module, and a determination module. The detection module is configured to obtain information from one or more detectors corresponding to a condition of a transportation network. The control module is configured to issue control messages using the information obtained. The input module is configured to receive a request for the control module to enter a test mode corresponding to an alteration of at least one of an input or an output of the control module from an operational mode. The determination module is configured to determine if an authorization condition corresponding to a physical state of one or more functional activity module of the transportation network is satisfied. The control module is transferred to the test mode if the authorization condition is satisfied and maintained in the operational mode if the authorization condition is not satisfied.

23 Claims, 3 Drawing Sheets

(56) References Cited

U.S. PATENT DOCUMENTS

| | | | | |
|---|---|---|---|---|
| 7,363,187 | B2 | 4/2008 | Winkler et al. | |
| 7,966,126 | B2 | 6/2011 | Willis | |
| 8,214,091 | B2 | 7/2012 | Kernwein | |
| 8,406,940 | B2 | 3/2013 | Otsubo | |
| 2008/0288202 | A1* | 11/2008 | Winkler | B61L 19/06 702/115 |
| 2009/0177344 | A1 | 7/2009 | James | |
| 2011/0084176 | A1 | 4/2011 | Reichelt | |
| 2015/0210303 | A1* | 7/2015 | Seidler | B61L 11/00 701/19 |

* cited by examiner

SYSTEMS AND METHODS FOR MAINTAINING INTERLOCKINGS OF TRANSPORTATION NETWORKS

RELATED APPLICATIONS

This application claims priority to U.S. Provisional Application Ser. No. 61/833,166, filed 10 Jun. 2013, and entitled "Systems And Methods For Maintaining Interlockings Of Transportation Networks," the content of which is hereby incorporated by reference in its entirety.

TECHNICAL FIELD

Embodiments of the subject matter described herein relate to testing and/or maintaining interlockings of transportation networks.

BACKGROUND

Transportation networks may include a variety of field devices, with the field devices monitored and controlled to provide safe and reliable operation of the network. For example, field devices may be employed to detect one or more states or conditions of a transportation network, and/or to provide one or more states of operation. The information from one or more of the field devices may be provided to a central control system, which determines control actions for vehicles of the transportation networks using the provided information, and the central control system may provide control commands to one or more of the field devices to implement the control actions.

An interlocking may be employed to prevent conflicting vehicles from traversing the same portion of a route or track, to prevent a vehicle from passing over a switch or other device that is not properly set, or the like. The term "interlocking" may refer to a control scheme and/or control system that is configured to prevent one or more aspects of a transportation network from operating in a specified prohibited manner based on a condition or conditions of one or more other aspects of the transportation network. It may be noted that a portion of the transportation network associated with such a control scheme may also be referred to herein as an "interlocking." Interlockings at crossings and/or junctions of transportation networks may be employed to prevent, for example, the granting of permission to enter a portion of the network or the display of a clear signal from one route when clearance has already been given to a conflicting vehicle, or if a conflicting vehicle is detected or determined as present on a conflicting route.

As one example, a vehicle transportation system may include tracks over which rail vehicles travel. These tracks may cross routes of other transportation systems, such as road or highway systems over which automobile traffic may pass. Further, tracks of different routes (and/or tracks forming sub-routes of a given route) may cross each other or be linked to allow for railroad crossings at grade (e.g., switches may allow a vehicle to transfer from one track or sub-route to a different track or sub-route). Wayside units may be disposed alongside tracks to monitor tracks for potential occupancy of tracks, to monitor the status of switches, to provide information and/or commands to rail vehicles in conjunction with Positive Train Control (PTC) systems, operate highway crossings, or the like.

Such interlockings may include discrete interfaces between controllers (e.g., solid state safety critical controllers) and field devices. Such discrete interfaces may connect at a terminal board. For maintenance purposes, the terminal board may contain an arrangement of test links such that the field devices may be disconnected from the controllers for the purpose of troubleshooting or testing the integrity of the cabling between the devices and the controllers without disarranging the connections between them. The test links may be employed by maintenance personnel when troubleshooting an interlocking. With a connection (or connections) between a controller and field devices broken, the maintenance personnel may then use a physical connection, such as jumper wires, to manually override the actual conditions of the field devices or controllers. As an example, maintenance personnel may apply voltages to the broken connections to bypass the voltages into or out of the controller. Such an approach allows for troubleshooting of an interlocking; however, such an approach is subject to safety concerns, for example safety issues caused by human error, inattention, or miscommunication.

For example, in the context of a rail transportation network, maintenance personnel may be troubleshooting a track switch that was intermittently reporting position of the switch to the controller. Such a condition, as properly designed, would not allow a dispatcher to clear the signal to allow train movement into the interlocking due to the intermittent reporting by the track switch. Maintenance personnel may use the test links to disconnect the track switch from the controller and to bypass the indication to the controller by applying jumper wires to the appropriate inputs of the controller. For example, such a bypass may be performed to attempt to determine if the issue with the intermittent reporting is in the controller, in the track switch, in the wiring from the track switch to the controller, or in the communication between the controller and the dispatcher.

However, if the dispatcher and the maintainer are not in detailed communication with each other, the track switch may appear to be properly indicating to the dispatcher, when in fact the indication to the dispatcher is the result of the bypass procedure. The dispatcher may then improperly clear the signal and allow a train to approach the interlocking. Thus, a train may traverse a track switch which was not aligned properly (e.g., for a given speed of the train), and the train may be derailed. Certain systems may provide for test modes for certain signaling equipment, for example to turn various lamps on within a signal head for cleaning, alignment, and adjustment; however, such testing procedures do not sufficiently address, for example, potential safety issues with troubleshooting switches or other mechanical components of a transportation network.

BRIEF DESCRIPTION

In an embodiment, a system includes a detection module, a control module, and a determination module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

The detection module is configured to obtain information from one or more detectors corresponding to at least one of a condition or status of a transportation network. The control module is configured to issue control messages to at least one vehicle using the information obtained from the detection module when the control module is operating in an operational mode. The control module is configured to receive a request for the control module to enter a test mode. The test mode corresponds to an alteration of at least one of an input or an output of the control module from the operational mode. The at least one of the input or the output corresponds to a status or setting of a functional activity module of the transportation network. The determination module is configured to determine if an authorization condition associated with the test mode is satisfied. The authorization condition corresponds to a state of one or more elements of the transportation network. The control module is configured to enter the test mode, responsive to receipt of the request, if the authorization condition is satisfied and to continue operating in the operational mode if the authorization condition is not satisfied.

In an embodiment, a method includes receiving, at one or more processing units of a wayside system associated with a control system for controlling a vehicle traversing a transportation network, a request for the control system to enter a test mode. The test mode corresponds to an alteration of at least one of an input or an output of a control module of the control system from an operational mode. The at least one of the input or the output corresponds to a status or setting of a functional activity module of the transportation network. The method also includes determining, at the one or more processors, if an authorization condition associated with the test mode is satisfied. The authorization condition corresponds to a state of one or more elements of the transportation network corresponding to the wayside system. Also, the method includes transferring the control system to the test mode, responsive to the request, if the authorization condition is satisfied, and continuing operation of the control system in the operational mode if the authorization condition is not satisfied.

In an embodiment, a tangible and non-transitory computer readable medium includes one or more computer software modules configured to direct one or more processors to receive a request for a control system to enter a test mode, the test mode corresponding to an alteration of at least one of an input or an output of a control module of the control system from an operational mode, the at least one of the input or the output corresponding to a status or setting of a functional activity module of a transportation network; determine if an authorization condition (e.g., an authorization condition corresponding to a state of one or more elements of a transportation network) associated with the test mode is satisfied; transfer the control system, responsive to the request, to the test mode if the authorization condition is satisfied; and continuing operation of the control system in the operational mode if the authorization condition is not satisfied.

In an embodiment, a system includes a detection module, a control module, and a determination module. The detection module is configured to obtain information from one or more detectors relating to a transportation network. The control module is configured to issue control messages to at least one vehicle using the information obtained from the detection module when the control module is operating in an operational mode. The control module is also configured to receive a request for the control module to enter a test mode. The determination module is configured to determine if an authorization condition associated with the test mode is satisfied. The authorization condition corresponds to a state of the transportation network. Responsive to receipt of the request, the control module is configured to enter the test mode if the authorization condition is satisfied and the control module is configured to continue operating in the operational mode if the authorization condition is not satisfied.

In an embodiment, a system includes a wayside control module configured, when operating in an operational mode, to issue control messages to at least one vehicle based on information obtained about a status of a transportation network in which the vehicle travels. The wayside control module is further configured, responsive to a request to enter a test mode of operation of the control module, to enter the test mode if an authorization condition of the test mode is satisfied and to continue operating in the operational mode if the authorization condition is not satisfied.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
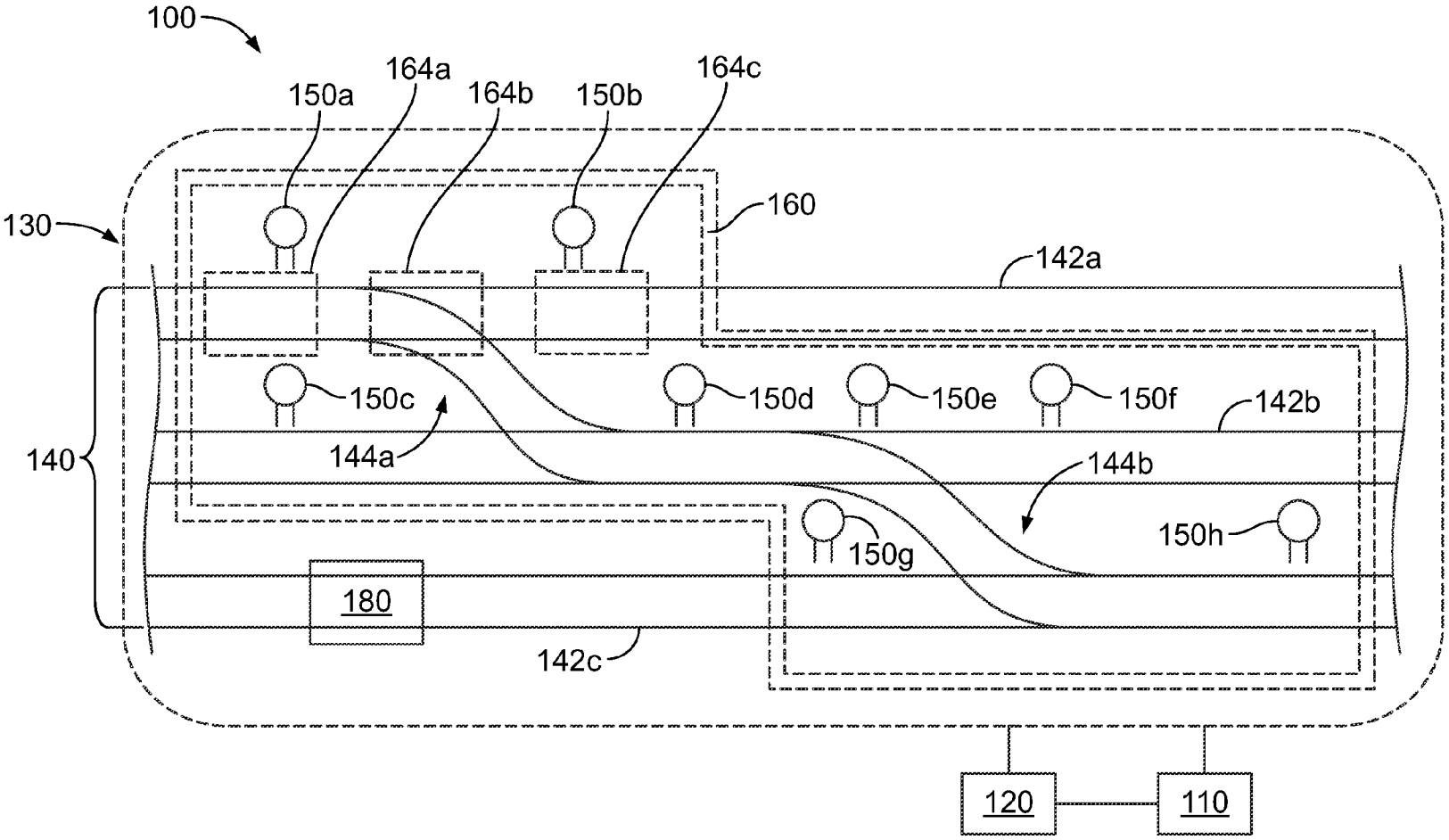
FIG. 1 is a schematic view of a transportation network and testing system in accordance with an embodiment.

One or more embodiments of the inventive subject matter described herein provide systems and methods for improved maintenance of interlockings for a transportation network and related equipment. In various embodiments, systems and methods for authorizing and/or revoking a test mode for certain discrete interfaces of a controller are provided.

In various embodiments, systems and methods for maintenance of interlockings controlled by or otherwise associated with wayside equipment of a rail transportation network are provided. In various embodiments, the wayside equipment may be configured to communicate with an onboard system configured to control movement of a vehicle (e.g., a rail vehicle) and/or to control equipment associated with a crossing, junction, or other aspect of a route (e.g., track detection equipment, switches, or the like). The control systems for the rail vehicle, for example, may be configured to be compatible with Positive Train Control (PTC) systems utilized in the United States. For example, bidirectional communications between onboard equipment and wayside equipment may be used to communicate information and/or control instructions between the rail vehicle and the wayside equipment. The wayside equipment, or other controller of an interlocking, may utilize information from a dispatcher and/or route detectors (e.g., information describing physical detection of a switch status, information describing physical detection of a vehicle occupying a portion of a route, or the like) to determine the appropriate control commands to be provided as part of the PTC system control (e.g., if a track is clear for entry, if a track is not clear, a speed limit, or the like).

As indicated above, in various embodiments, systems and methods for authorizing and/or revoking a test mode for certain discrete interfaces of a controller are provided. For example, the controller may use an application logic program that defines, describes, or otherwise specifies how inputs to the controller relate to outputs of the controller (e.g., by defining one or more outputs for a specific combination of inputs). The safety critical design of how the controller handles the inputs and outputs, along with the design of the application logic program, combine to prevent or reduce the occurrence of unsafe situations at an interlocking associated with the controller. As just one example, the outputs of a controller for a railroad signal may be programmed such that a signal allowing entry into a portion of a route may not be cleared unless a track switch beyond the signal is locked and lined in a proper position and all associated track sections are not occupied.

In various embodiments, any input (or group of inputs) and/or any output (or group of outputs) may be associated with a set of logic variables to request entry into a test mode for those inputs and outputs, and to authorize (or prohibit) entry into the test mode. In various embodiments, a test mode may be understood as a collection of inputs and outputs that differ in some way from an operational mode, or that differ from the values of those inputs and outputs that would be encountered during operation of a transportation network as intended. An operational mode as used herein may be understood as a mode corresponding to values of inputs and outputs set according to current detection information and/or current information from one or more centralized dispatches. For example, for an input that is being reported as "true" in an operational mode, that particular input may be reported as "false" in a specified test mode. Thus, a test mode may include a specification of one or more particular alterations of at least one of an input or an output of the control module from an operational mode, and/or may include a request, capability, or permission to alter values for one or more inputs and/or outputs. A request variable, for example, may follow an external request made by maintenance personnel (e.g., a request made via computer access of a user interface). Further, in various embodiments, additional security may be provided by ensuring that a maintenance operator is locally present at the interlocking before allowing the request.

An authorization variable may be programmed to monitor conditions (e.g., status of one or more switches, occupancy of one or more sections of track, or the like) of the interlocking. Thus, if conditions are deemed safe for performance of a test, the authorization variable may be set to a value permitting entry into a test mode, while if conditions are not deemed safe for performance of the test, the authorization variable may be set to a value prohibiting entry into the test mode. For example, the controller may evaluate the request variable against the corresponding authorization variable and only allow entry into a test mode if the authorization variable is in the proper state. In some embodiments, if the test mode is allowed, then maintenance personnel may command the state of one or more inputs or outputs associated with those 2 logic variables (e.g., the request variable and the corresponding authorization variable). Yet further still, if the test mode is entered, the conditions of the interlocking (e.g., the value or state of the authorization variable) may be monitored, and if the conditions are no longer deemed safe for presence in the test mode, the controller may automatically or autonomously revoke the state of the inputs or outputs commanded by the maintainer and return control to the application logic program (e.g., transfer from the test mode to the operational mode).

For instance, in one example scenario, in the context of a rail transportation network, maintenance personnel may be troubleshooting a track switch that was intermittently reporting position of the switch to the controller. In contrast to the use of jumper cables, in various embodiments maintenance personnel may request to enter a test mode for the inputs to the controller that represent the switch position. For example, the authorization bit (or variable) for the particular inputs may be set based on nearby train occupancies and whether or not pertinent signals are cleared for train movements. If the conditions (as indicated, for example by one or more detectors associated with the interlocking and/or information from a dispatch or other centralized source) indicate that there are not relative train movements near the interlocking, the authorization bit may be set to allow transfer into the test mode, with the maintenance personnel allowed to change the switch indication via the controller in the test mode rather than performing a physical bypass (e.g., apply jumper wires). The test mode may have a timer associated therewith, so that should the maintenance personnel neglect to exit the test mode within a specified amount of time, or neglect to provide a request to remain in the test mode for a longer period of time, the controller may revoke the test mode and return to operational mode. Further, if the conditions change such that specified authorization conditions are not met (e.g., a train approaches the pertinent location), the test mode may be revoked and the system returned to operational mode.

A technical effect of embodiments includes improved safety in troubleshooting interlockings. A technical effect of embodiments includes improved convenience and/or efficiency in maintaining or troubleshooting of interlockings. A technical effect of embodiments includes elimination or reduction of equipment damage or injury due to human error in performing maintenance or troubleshooting of interlockings. A technical effect of embodiments includes improved ongoing monitoring of safety conditions during maintenance or troubleshooting of interlockings. A technical effect of embodiments includes improved coordination of equipment and/or vehicles during maintenance or troubleshooting of interlockings.

FIG. 1 is a schematic view of a transportation network 100 in accordance with an embodiment. The transportation network 100 includes a wayside module 110 communicatively coupled with a dispatch center 120, and plural network elements 130. The wayside module 110 and the dispatch center 120 are communicatively coupled with each other as well as one or more network elements 130. The embodiment depicted in FIG. 1 is configured as a rail vehicle transportation network, and the network elements 130 include a route 140, switches 144*a*, 144*b*, signals 150*a*, 150*b*, 150*c*, 150*d*, 150*e*, 150*f*, 150*g*, 150*h*, a track detection system 160, and a vehicle system 180.

Generally, one or more vehicle systems of the transportation network 100 are configured to traverse over or through the route 140. The travel of the vehicle systems through the transportation network 100 may be managed, controlled, coordinated, or the like via one or more of the dispatch center 120, the wayside module 110, onboard control systems, or the like. For example, the dispatch center 120 may develop schedules, time lines, or the like for various vehicles. Further the dispatch center 120 (e.g., network personnel working at one or more dispatch centers and/or control systems associated with one or more dispatch centers) may monitor the operation of the transportation network 100, identify any conflicts between vehicle systems (or any safety issues that may conflict with the passage of a vehicle system over a particular portion of the route 140), arbitrate between any identified conflicts, and provide instructions, messages, or control commands to the vehicles to resolve any identified conflicts.

In various embodiments, the route 140 may include one or more of rails, tracks, lanes, roads, paths, or the like. In the illustrated embodiment, the route 140 includes subroutes 142*a*, 142*b*, and 142*c*. The depicted subroutes 142*a*, 142*b*, and 142*c* are configured as rail tracks for the passage thereon of rail vehicles. In the illustrated embodiment, three generally parallel subroutes are depicted for a portion of the route 140 shown in FIG. 1. In various embodiments, other arrangements or configurations may be employed.

The switches 144*a*, 144*b* of the illustrated embodiment are configured for transferring vehicles between subroutes of the route 140. For example, in the embodiment depicted in FIG. 1, the switch 144*a* is configured to permit transfer of a vehicle between subroutes 142*a* and 142*b*, and the switch 144*b* is configured to permit transfer of a vehicle between subroutes 142*b* and 142*c*. In various embodiments, the switches 144*a*, 144*b* may include detection modules configured to detect the position of a switch, and be configured to report the detected position of the switch to the wayside module 110 and/or the dispatch center 120.

For example, in various embodiments, a switch may have three positions, conditions, or states that may be reported by the switch to the wayside module 110, namely, normal, reverse, and out of alignment. The normal position or state corresponds to a position of the switch for which a vehicle passing over the switch will remain on the same track. The reverse position or state corresponds to a position of the switch for which a vehicle passing over the switch will diverge or be transferred to a different track. The out of alignment position corresponds to an intermediate position that does not correspond to normal or reverse. For example, a switch in the out of alignment position may be the result of a mechanism of the switch that has bound and prevented proper alignment of the switch in the normal or reverse position, a motor of the switch that has failed, or the like. In various embodiments, a switch may be actuated between the normal and reverse position based on messages or commands from the wayside module 110 (and/or the central dispatch 120), and/or may report a state or position of the switch to the wayside module 110 (and/or the central dispatch 120).

The signals 150*a*, 150*b*, 150*c*, 150*d*, 150*e*, 150*f*, 150*g*, 150*h* are configured to provide a display of whether a corresponding portion of the route 140 (e.g., a corresponding length of a particular subroute or subroutes) is clear or not. In the embodiment depicted in FIG. 1, there are 8 signals shown. In FIG. 1, the switches 144*a*, 144*b* define 4 contact points where a switch contacts a subroute, and a signal is positioned to protect each contact point on either side. Thus, with 4 contact points and 2 signals per contact point, 8 signals are shown. In FIG. 1, the signals 150*a* and 150*b* protect either side of the contact point corresponding to the switch 144*a* and the subroute 142*a*. The signals 150*c* and 150*d* protect either side of the contact point corresponding to the switch 144*a* and the subroute 142*b*. Further, the signals 150*e* and 150*f* protect either side of the contact point corresponding to the switch 144*b* and the subroute 142*b*. Also, the signals 150*g* and 150*h* protect either side of the contact point corresponding to the switch 144*b* and the subroute 142*c*.

If the portion of the route 140 is clear, then a corresponding signal or signals may provide a clear signal, and a vehicle system may enter that portion. If the portion is not clear (e.g., the portion is occupied by another vehicle, a switch is misaligned, a portion of the route is damaged or otherwise not safe for travel, or the like), then the signal provides an indication to a corresponding vehicle not to enter the portion of the route 140. Various indications may be provided by a signal. For example, a signal may be configured to provide a stop signal (e.g., a red light), a clear signal (e.g., a green light), a caution or slow signal (e.g., a yellow light) or the like. For example, if a switch is determined to be out of alignment (e.g., based on information reported by the switch to the central dispatch 120, the wayside module 110, or the like), or aligned in a position that conflicts with a trip plan or mission plan of a vehicle, one or more signals associated with the portion of the route 140 including the switch may be set to a stop position (e.g., a red light). As another example, if a portion of the route 140 is determined to be occupied (e.g., based on scheduling information from the central dispatch 120, occupancy detected by the track detection system 160, location information reported by one or more vehicles, or the like), a signal for that particular portion of the route 140 may be set to provide a stop indication. In various embodiments, the wayside module 110 and/or the central dispatch 120 may be configured to determine the indication to be provided by the signal and to provide a command or instruction to the signal to display the appropriate indication.

The track detection system 160 in the illustrated embodiment is configured to detect physical occupancy of one or more vehicles within a predetermined range (or ranges) of an interlocking. The track detection system 160 may include plural track detection sub-systems, with each track detection sub-system configured to detect occupancy for a particular portion of the range of the track detection system 160. For example, in the illustrated embodiment, individual track detection sub-systems may be used to detect occupancy approaching each signal from either side. Further, individual track detection sub-systems may be used to detect occupancy between signals (e.g., over a switch or portion of track corresponding to a switch). For ease of illustration, only three track detection sub-systems associated with the signals 150*a* and 150*b* are shown in FIG. 1; however, additional sub-systems may be employed (e.g., in conjunction with other signals and/or switches). As seen in FIG. 1, the track detection system 160 (indicated by adjacent dashed lines) includes detection sub-systems 164*a*, 164*b*, 164*c* (indicated by single dashed lines). The sub-system 164*a* is configured to detect occupancy approaching either side of the signal 150*a*, the sub-system 164*b* is configured to detect occupancy between the signals 150*a* and 150*b* (e.g., over the contact between switch 144*a* and the subroute 142*a*), and the sub-system 164*c* is configured to detect occupancy approaching either side of the signal 150*b*. In various embodiments, the track detection system 160 (or sub-systems of the track detection system 160) may be configured as a track occupancy detection system that provides information limited to describing whether or not a particular portion of the route 140 (e.g., a specified length of one or more subroutes within the range 162) is occupied by a vehicle. The track detection system 160 may provide information to the wayside module 110 and/or the central dispatch 120.

Some of the network elements 130 discussed herein may be understood as functional activity modules or physical activity modules. As used herein, a functional activity module or physical activity module may be understood as an element of a transportation network that is configured to one or more of detect a physical operation, condition, or state of a component or system of the transportation network, or is configured to perform a physical activity during the course of the intended operation of the transportation network. For example, a switch may be understood as a functional activity module or physical activity module because a switch may be able to detect a physical condition (e.g., a state such as normal, reverse, or out of alignment which may be provided to the wayside module 110) and/or may perform a physical activity during the intended operation of the transportation network 100 (e.g., actuate from a forward position to a reverse position or the like). As another example, the track detection system 160 may be understood as a functional activity module or physical activity module because the track detection system 160 may detect a physical condition (e.g., physical occupancy by a vehicle of a portion of the route 140 within the range 162. In contrast, some network elements 130 in various embodiments may not be understood as functional or physical activity module. For example, because the signals 150*a*, 150*b*, 150*c*, 150*d*, 150*e*, 150*f*, 150*g*, 150*h* do not detect a physical activity (e.g., translation or movement of a mechanical component) and do not perform a physical activity, but instead merely provide a visual display pursuant to an instruction received, for example, from the wayside module 110, the signals may not be understood as functional or physical activity modules as used herein.

The vehicle system 180 is configured to traverse the route 140. In the illustrated embodiments, the vehicle system 180 is disposed upon the subroute 142*c*. The vehicle system 180 may, for example, be configured as a rail vehicle system, such as a rail vehicle consist. In various embodiments, the vehicle system may operate pursuant to a positive train control (PTC) system. A positive train control system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a positive train control system may force a train to slow or stop based on the condition of a signal, switch, crossing, or the like that the train is approaching. In other embodiments, other types of vehicle systems, such as trucks, automobiles, watercraft, or the like, may be employed.

In various embodiments, the wayside module 110 may obtain information from the dispatch center 120 (e.g., location or scheduling information corresponding to the current or upcoming position of one or more vehicles), the switches 144*a*, 144*b*, and the track detection system 160. Based on the information received, the wayside module 110 may determine if the vehicle system 180 should be allowed to proceed along a mission (e.g., at a specified speed) in a specified direction over a specified portion of the route 140, or if the vehicle system 180 should be slowed or stopped based, for example, on a switch being in an inappropriate condition, position, or state, occupancy of the relevant portion of the route 140 by one or more other vehicles, a safety or repair condition of the relevant portion of the route 140, or the like.

Generally, in various embodiments, the wayside module 110 may be configured to control the operation of the transportation network 100 associated with an interlocking in conjunction with, for example, a PTC system. For example, the wayside module 110 may obtain information regarding track occupancy and/or settings from devices such as switches (or detectors associated with the devices), as well as information from the dispatch center 120. The wayside module 110 may then determine control actions for the vehicle system 180 based on the most restrictive identified option. For example, if information from devices (e.g., functional or physical activity modules as discussed herein such as switches, track detection systems, or the like) indicates that a portion of the route 140 is clear but the dispatch center 120 provides information indicating that the portion is not clear, the wayside module 110 may provide control commands to the vehicle system 180 preventing entry into the portion of the route 140. As another example, if information from the dispatch center 120 indicates that a portion of the route 140 is clear but information from the devices indicate that the portion is not clear, the wayside module 110 may provide control commands to the vehicle system 180 preventing entry into the portion of the route 140. If both information from devices and the dispatch center 120 indicate a portion of the route 140 is clear, then the vehicle system 140 may be controlled to permit entry into the portion of the route 140.

In various embodiments, the wayside module 110 may include a communication module (e.g., a module configured to facilitate communication with vehicles, dispatch centers, or the like), a detection module (e.g., a module configured to obtain and/or process information from detectors), and a control module (e.g., a module configured control of one or more vehicles traversing the transportation network 100, for example in conjunction with a PTC system). One or more modules of the wayside module 110 may also include a memory for storing and/or executing application logic for processing of various inputs from other aspects of the transportation network to provide outputs to other aspects of the wayside module 110 and/or other aspects of the transportation network 100.

As indicated above, the wayside module 110 in the depicted embodiment is configured to receive information from the dispatch center 120 and various of the network elements 130, and to control the transportation network 100 (e.g., control or administer an interlocking) accordingly. However, the ability of the wayside module 110 to control or administer an interlocking to allow normal operations is limited by the information provided to the wayside module. For example, if a device is malfunctioning or otherwise reporting information incorrectly, the interlocking may be configured to restrict normal operations of the interlocking in order to provide safety. Thus, one or more devices associated with the interlocking may be periodically maintained and/or may be evaluated as part of a troubleshooting analysis. In various embodiments, the wayside module 110 may allow for maintenance of an interlocking without requiring an operator to position or monitor physical bypass mechanisms such as jumper wires. The wayside module 110 may also be configured to determine that the transportation network 100 is in a safe condition for troubleshooting or maintenance to be performed, and, in various embodiments, to determine if the transportation network 100 remains in a safe condition during the troubleshooting or maintenance.

In various embodiments, the wayside module 110 may be configured to receive a request to enter a test mode for a particular interlocking. The request may specify a specific alteration (or alterations) to be made to one or more inputs and/or outputs from the settings of the inputs and/or outputs in an operational mode. As another example, the request may specify one or more particular inputs or outputs which may be altered during use of the test mode. For example, a request for entry into a test mode may specify one or more inputs or outputs corresponding to a state of a functional activity module or an action by a functional activity module that will be changed from the corresponding value from an operational setting (with the operational setting reflecting the present operation of the transportation network 100 as intended).

Based on the inputs or outputs corresponding to the test mode request, the wayside module 110 may identify or determine an authorization condition for the test mode. For a given request, certain safety conditions may be specified as an authorization condition. The authorization condition may, for example, specify or otherwise correspond to a state of one or more elements of the transportation network. For example, the authorization condition may specify a physical state of one or more physical or functional activity modules. Additionally or alternatively, the authorization condition may specify a state of one or more signals. Additionally or alternatively, the authorization condition may specify a state of the transportation network 100 as indicated by the dispatch center 120 (e.g., an indication from the dispatch center 120 that no vehicles are on a particular portion of the route 140 or planned to be on the portion of the route 120 within a pertinent time period).

The satisfaction of a particular authorization condition may be indicated by the value or setting of an authorization variable or bit associated with a particular test mode. If the authorization code is satisfied, the wayside module 110 may be configured to allow entry into the test mode, and alteration of one or more inputs or outputs associated with the interlocking. If the authorization code is not satisfied, the wayside module 110 may be configured to prevent entry into the test mode, with settings of the inputs and outputs remaining unchanged from the operational mode. Further still, in various embodiments, after an entry into a test mode, the wayside module 110 may be configured to monitor whether or not the authorization condition remains satisfied (e.g., by checking the value of the authorization variable or bit periodically), and returning to the operational mode if the authorization condition does not remain satisfied.

An example scenario will be discussed to illustrate the operation of the wayside module 110 and the administration or control of an interlocking during a troubleshooting or maintenance procedure in accordance with various embodiments. In the example scenario an issue with the switch 144*b* has been identified. For example, the switch 144*b* may be reporting intermittently. Thus, in the example scenario, troubleshooting may be performed to determine, for example, if there is a problem with the switch itself, a problem in communication between the switch 144*b* and the wayside module 110, or a problem with the wayside module 110 with respect to processing or handling information sent from the switch 144*b*. Maintenance personnel thus may request entry into a test mode allowing for the variation of inputs (and/or outputs) corresponding to the reported position of the switch 144*b*.

In the example scenario, the wayside module 110 may then identify or determine if the appropriate authorization conditions are met for entry into the particular test mode. For example, the authorization conditions may include one or more of signal information or occupancy information. Signal information may include the status for one or more signals corresponding to nearby portions of the route 140. For example, if the signal 150*e* positioned to the left of the switch 144*b* along the subroute 142*b* in FIG. 1 is providing a "clear" indication such that a vehicle may pass by the signal 150*e* and over the switch 144*b*, the authorization conditions may not be met. Thus, the authorization conditions may include signal information including a status of the signal 150*e* (and/or additional signals) as "stop," "not clear," or the like.

As indicated herein, the authorization conditions may also include occupancy information. As one example, the dispatch center 120 may provide the wayside module with information regarding current vehicle locations or movements, and/or planned or prospective vehicle locations or movements within a predetermined amount of time. Thus, if the dispatch center 120 provides information indicating that a nearby portion of the route 140 is presently occupied or will soon be occupied (e.g., occupied before estimated completion of a troubleshooting or maintenance task), the wayside module 110 may prohibit or prevent entry into the test mode. As another example, in various embodiments, occupancy information may be provided by the track detection system 160.

It may be noted that in various embodiments, the test mode and/or the corresponding authorization conditions may be pre-programmed (e.g., set at a manufacture or assembly stage of the wayside module 110) and/or user programmable (e.g., set, modified, supplemented, revised, or the like by a user of the transportation network 100 or a service provider of the transportation network 100 at a subsequent time). Thus, in some embodiments, the authorization conditions may be provided at or about the same time as the request for test mode entry. For example, an operator may enter a request to enter a test mode using a personal computer (PC) operably connected to the wayside module 110. The operator may also, via the PC, identify the appropriate authorization conditions, or, as another example, identify a predetermined authorization variable or condition to be evaluated. Additionally or alternatively, the wayside module may store or have access to plural predetermined authorization conditions (e.g., stored in a database and correlated to corresponding test modes), and autonomously identify an authorization condition to evaluate based on the requested test mode. In the above discussed example scenario, a test mode where values relating to only one device (e.g., a switch) was discussed; however, in alternate embodiments a test mode may correspond to altered values for plural devices, inputs, and/or outputs.

Figure 2:
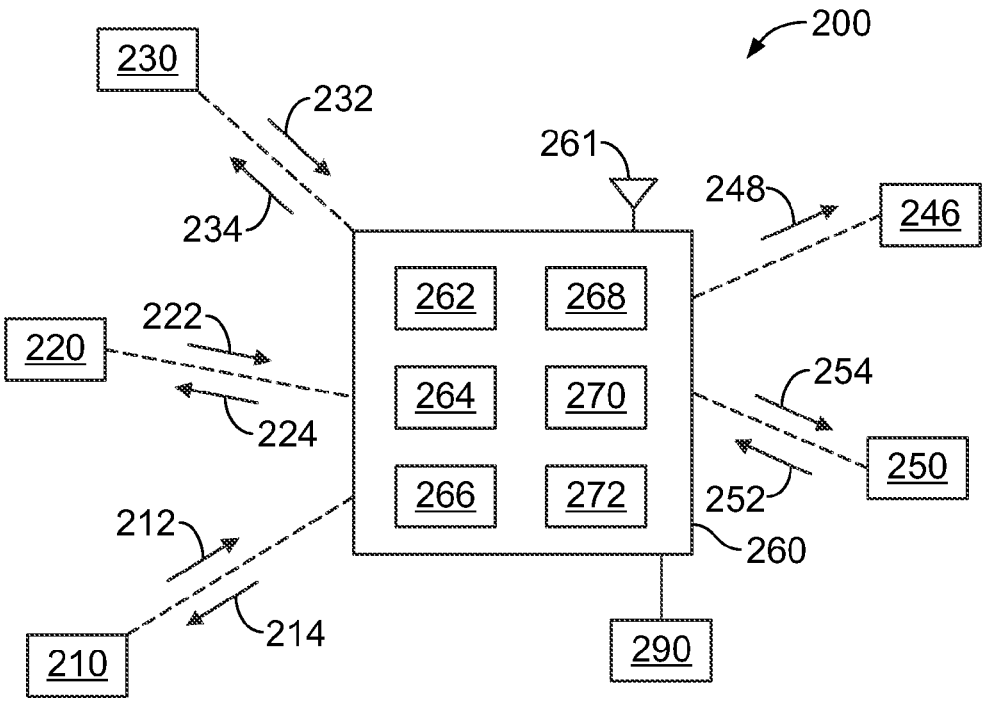
FIG. 2 is a schematic view of a transportation network in accordance with an embodiment.

FIG. 2 is schematic view of a transportation network 200 in accordance with an embodiment. The transportation network 200 includes a vehicle 210, a switch 220, a track detection module 230, a signal 246, a central dispatch 250, an interlocking controller 260, and a user request module 290. As discussed in connection with FIG. 1, the vehicle 210, switch 220, track detection module 230, or the like may be understood as elements of the transportation network 200. Generally, only one of each element shown in FIG. 2 is depicted; however, it may be noted that plural members of one or more of the elements may be employed in various embodiments. For example, an interlocking controller may be associated with plural switches, track detection modules, or signals, among others.

Information (e.g., contained in signals, messages, or the like) from various network elements may be inputs to the interlocking controller 260 (e.g., one or more submodules of the interlocking controller 260), and the interlocking controller 260 may provide outputs to the various network elements. The interlocking controller 260 may determine the outputs based on the inputs via an application logic program. The relationships between the inputs and outputs, in either an operational mode and/or one or more test mode may be user programmable. For example, after the interlocking controller 260 has been in service for a period of time, a user may provide an additional test mode for use in performing a troubleshooting or maintenance activity, and/or store the additional test mode in a memory for future use.

Generally, in various embodiments, the interlocking controller 260 is configured for unilateral and/or bilateral communication with one or more additional elements of the transportation network 200. Information may be communicated wirelessly (e.g., via the antenna 261). Additionally or alternatively, information may be communicated over a hard-wired connection. Further, information may be communicated as part of a message in a specified format. Additionally or alternatively, information may be communicated as part of a signal, for example a particular input may be configured as the provision of a signal having a specified voltage level.

As one example, the vehicle 210 may transmit a message 212 to the interlocking controller 260 including information regarding the speed of the vehicle, a track or subroute the vehicle 210 is traversing, a location of the vehicle 210, an estimated time of arrival of the vehicle 210 at a given location, or the like. The interlocking controller 260 may transmit a message 214 to the vehicle 210 including information regarding a location of one or more elements of the transportation network 200 (e.g., a wayside station, a crossing, or the like), a setting of one or more switches, control commands or instructions (e.g., pursuant to a PTC system), or the like.

As another example, the switch 220 may transmit a message or signal 222 to the interlocking controller 260 regarding the position of the switch 220 (e.g., normal, reverse, or out of alignment). The interlocking controller 260 may transmit a message or signal 224 to the switch 220 including a control command for the switch (e.g., to change from a given position to a different position).

As another example, the track detection system 230 may transmit a message or signal 232 to the interlocking controller 260 regarding the presence or absence of one or more vehicles on one or more portions of a route. For example, the track detection system 230 may transmit information to the interlocking controller 260 corresponding to whether or not a given portion of the route is occupied (e.g., where the track detection system 230 is configured as a track occupancy detection system). The interlocking controller 260 may be configured to transmit a message 234 to the track detections system 230 including a control command (e.g., an instruction to switch from an energy-conserving sleep mode to an active mode), a request for more information, or the like.

As another example, the interlocking controller 260 may transmit a message or signal 248 to the signal 246 instructing the signal 246 to provide a particular display (e.g., light one or more green lamps, light one or more yellow lamps, light one or more red lamps, or the like).

As one more example, the interlocking controller 260 may be configured for bilateral communication with the dispatch center 250. For example, the dispatch center 250 may transmit a message 252 to the interlocking controller providing control commands or instructions, location information of one or more vehicles, scheduling information for one or more vehicles, requests for information, or the like. The interlocking controller 260 may transmit a message 254 to the dispatch center 250 including information (e.g., information regarding the occupancy of one or portions of a route, information regarding a state or status of one or more additional network elements, or the like), information regarding whether the interlocking controller 260 is in a test mode, information regarding any aspects of the transportation network 200 related to the test mode, requests for information, or the like.

In the illustrated embodiment, the interlocking controller 260 includes a detection module 262, a control module 264, an input module 266, a determination module 268, a memory 270, and a functional activity control module 272. In various embodiments, the interlocking controller may be configured, for example, as a portion of a wayside station or other wayside equipment.

In the illustrated embodiment, the detection module 262 is configured to obtain information from one or more detectors corresponding to a condition or status of the transportation network 200. For example, the detection module 262 may receive position information from the switch 220, occupancy information from the track detection system 230, or the like. Additionally or alternatively, the detection module 262 may obtain information from the dispatch center 250 and/or the vehicle 210. Thus, the detection module 262 may be configured as or include a communication module configured to receive messages from and transmit messages to a dispatch center, a vehicle, or the like.

The control module 264 of the embodiment depicted in FIG. 2 is configured for control of an interlocking, for example, for control in conjunction with a PTC system. The depicted control module 264 is configured to issue control messages to the vehicle 210 using the information obtained from the detection module 262. Control messages, in various embodiments, may be issued directly to the vehicle 210 and/or indirectly (e.g., via a command to the signal 246 to provide a display visible to an operator of the vehicle 210, such as lighting a red lamp, a green lamp, or the like). For example, the control module 264 may obtain information from the detection module 262 indicating that the switch 220 is improperly aligned, and issue a command to the vehicle 210 to prevent the vehicle 210 from traversing over the switch. As another example, the control module 264 may obtain information from the detection module 262 indicating that the track detection system 230 has detected occupancy of a different vehicle along a portion of the route, and issue a command to the vehicle 210 to prevent the vehicle 210 from entering the portion of the route occupied by a different vehicle. As yet another example, the control module 264 may obtain information from the detection module 262 indicating that the dispatch center 250 has identified occupancy by a different vehicle along a portion of the route (or an upcoming scheduled occupancy by a different vehicle), and issue a command to the vehicle 210 to prevent the vehicle 210 from entering the portion of the route occupied by a different vehicle. Further, the control module 264 (and/or other aspect of the interlocking controller 260) may be configured to utilize an application logic program that defines or relates the various inputs and outputs of an interlocking control system.

In the illustrated embodiment, the input module 266 is configured to receive a request for the control module 264 to enter a test mode. For example, the input module 266 may receive a request from a user, and the control module 264 may receive a corresponding request from the input module 266. In various embodiments, the control module 264 may receive a user request directly. The request may be provided, for example, by maintenance personnel that have accessed the interlocking controller 260 to perform a troubleshooting or maintenance activity on one or more aspects of an interlocking system. The test mode may correspond to an alteration of at least one of an input or an output of the control module from an operational mode. For example, in a test mode, the value of an input or output may be varied from the value that particular input or output would have been using the information provided by the other elements of the transportation network 200 as processed by an application logic program configured for use during standard or intended operation of the interlocking controller 260. In various embodiments, the request for entry into a test mode may identify the test mode by identifying one or more inputs and/or outputs to be altered as part of the test mode. Additionally or alternatively, the request may identify the specific changes to be made to one or more inputs or outputs.

The determination module 268 of the embodiment depicted in FIG. 2 is configured to determine whether or not a request for entry to a test mode is granted. In various embodiments, the determination module 268 is configured to determine if an authorization condition associated with the test mode is satisfied. For example, the authorization condition may correspond to a physical state of one or more functional activity modules of the transportation network, such as the status or condition of the switch 220 and/or the occupancy of the route. In various embodiments, the occupancy of a portion of the route may be determined based on information from the track detection system 230, information from one or more vehicles regarding the current location or planned upcoming location of the one or more vehicles, information from the dispatch center 250 regarding the current or upcoming positions of one or more vehicles, or the like.

Additionally or alternatively, the authorization condition may correspond to a status of one or more signal lamps such as the signal 246 (e.g., "stop," "not clear," or the like). For example, for a given test mode, the authorization condition may specify that certain portions of track are unoccupied and that certain signals are set to a "stop," "not clear," "do not enter," or similar status. In various embodiments, the determination module 268 is configured to periodically determine if the authorization condition remains satisfied after an initial determination that the authorization condition is satisfied. The authorization condition may be checked periodically at a predetermined time interval in various embodiments. Thus, in various embodiments, the control module 264 (and/or other portion of the interlocking controller 260) may be transferred to the test mode if the authorization condition is satisfied and maintained in the operational mode if the authorization condition is not satisfied.

Further, if the authorization condition is initially satisfied and the control module 264 switched to the test mode, but a periodic check of the authorization condition reveals that the authorization condition has ceased to be satisfied, the control module 264 may be transferred back to the operational mode (e.g., transferred autonomously by the determination module 268 to the operational mode). In various embodiments, the physical state to which the authorization condition corresponds (e.g., an identification of one or more functional activity modules as well as the particular status of the one or more functional activity modules) as well at least one of the input or the output of the control module 264 associated with the test mode may be user programmable. In various embodiments, plural authorization conditions may be stored and correlated to corresponding test modes. Thus, the determination module 268 may be configured to select an appropriate authorization condition from the plural authorization conditions based on the test mode which the control module 264 was requested to enter. Once the appropriate authorization condition for a given test mode request has been determined or identified, the determination module 268 may determine if the authorization condition has been satisfied.

Generally, in various embodiments, the memory 270 is configured to store information, files, programs, or the like that may be utilized by one or more other modules of the interlocking controller 260. For example, the memory 270 may store the application logic program utilized during normal or intended operation of the interlocking controller 260. As another example, the memory 270 may store information describing or corresponding to various test modes (e.g., one or more inputs or outputs to be altered for a particular test mode). The memory 270 may also store information describing or corresponding to authorization conditions for the test modes.

In the illustrated embodiment, the functional activity control module 272 is configured to control a functional activity module to perform a given task. For example, the functional activity control module 272 may direct or control the switch 220 to move from a given position to a different position, or the like. The functional activity control module 272, for example, may receive or otherwise obtain an output of the control module 264. The particular output, for example, may be determined by the control module 264 operating in the operational mode, or, as another example, may be determined be the control module 264 operating in a test mode.

The user request module 290 of the embodiment depicted in FIG. 2 is configured to allow a user to request a transfer from an operational mode to a test mode. The user request module 290 may be communicatively coupled to the input module 266 or other aspect of the wayside system 260. In the illustrated embodiment, the user request module 290 is configured as a separate unit that may be temporarily coupled to the interlocking controller 260. In other embodiments, the user request module 290 may be configured as part of a single unit with the interlocking controller, for example as a part of a wayside station or other wayside equipment. In various embodiments, the user request module 290 may be configured as a personal computer (PC), and may include, for example, a user guide or other information configured to assist or guide an operator performing a troubleshooting or maintenance procedure.

In various embodiments, the interlocking controller 260 may require a password or other identification or authentication information to be provided before a request for entry into a test mode may be entered. Additionally or alternatively, the interlocking controller may be configured to prevent remote maintenance or troubleshooting activities, and may require verification from the operator that the operator is present at a particular on-site location before granting a request to enter a test mode. In various embodiments, the display may provide an indication if a request for entry into a test mode has been granted or denied (and may display an indication, such as a text message, describing why a request was denied), may provide a list of available inputs or outputs to vary for a given test mode, may provide guidance or suggestions for inputs or outputs to vary from operational values for a given troubleshooting procedure and/or test mode, or the like. In various embodiments, the user request module 290 may include a keyboard, stylus, or the like, configured to allow a user to input a request for a specific test mode and/or to allow a user to specify particular authorization conditions for given procedures. Alternatively or additionally, in various embodiments, the user request module 290 may be configured to provide a user with predetermined selections for a test mode and/or authorization condition, such as a pull-down list or the like. Further, the user request module 290 may periodically verify that the operator remains at the specified location and/or that the interlocking controller 260 should remain in the test mode. For example, the user request module 290 may be configured to periodically prompt a user or operator confirm that the troubleshooting or maintenance activity is still ongoing.

Figure 3:
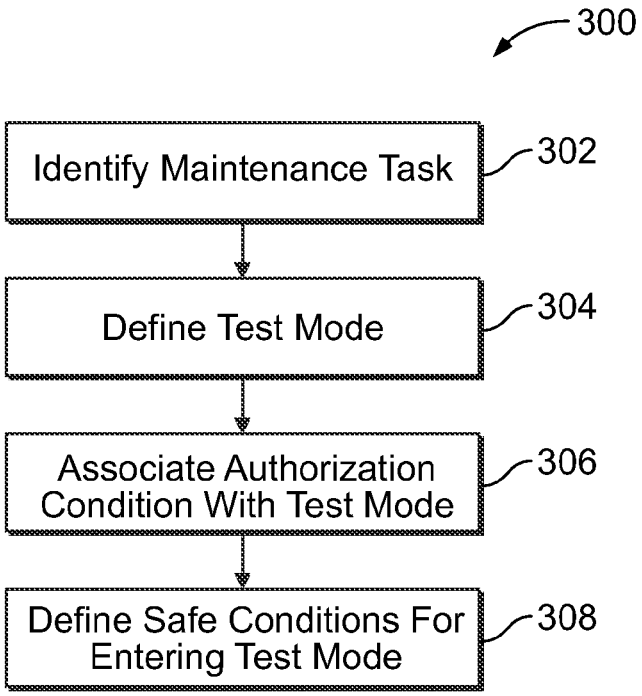
FIG. 3 is a flowchart of one embodiment for providing application logic for maintaining an interlocking.

FIG. 3 is a flowchart of one embodiment for providing application logic for maintaining an interlocking. The method 300 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 302, a maintenance task is identified. The maintenance task may be a periodic maintenance task, or may be a troubleshooting task. For example, an issue, or potential issue, may arise in connection with the operation of a transportation network, and a troubleshooting task identified. The task, for example, may be identified by identifying one or more devices for analysis or examination.

At 304, a test mode is defined. The test mode may be defined for the maintenance task identified at 302. Generally, in various embodiments, for each device identified by the maintenance task, a corresponding one or more inputs or outputs may be identified. The test mode may be defined by the specific inputs or outputs identified as corresponding with the devices. As one example, a maintenance task may be identified for troubleshooting a switch, and the test mode may be defined by one or more particular inputs or outputs of an interlocking controller corresponding to the particular switch.

At 306, the settings or parameters of an authorization condition associated with the test mode are identified, and the authorization condition is associated with the test mode. The authorization condition in various embodiments may reflect the status, state, or condition of the transportation network, for example a portion of the transportation network (e.g., a section or length of track or tracks, devices such as switches positioned along the section or length of track or tracks, signals corresponding to the section or length of track or tracks, or the like). The status, state, or condition of the transportation network may be defined by the setting of a signal, whether or not a particular portion of a track is occupied, whether a switch is in a given position, or the like. Generally, in various embodiments, the authorization condition includes one or more settings or statuses corresponding to portions of the transportation network nearby or in close proximity to the device for which the test mode has been defined. For example, for a test mode for a switch, the occupancy of nearby track and settings of nearby signals may define the authorization condition and be associated with the test mode defined at 304.

At 308, safe conditions for authorizing entry into the test mode (e.g., the test mode defined at 304), are defined. For example, the particular settings for the status, states, or conditions identified for the associated authorization condition may be specified. For example, for a test mode for a switch and corresponding authorization conditions including the occupancy of nearby track and settings of nearby signals, the safe conditions may be defined as no vehicles occupying the nearby track (e.g., as determined based on information from a dispatch office and/or track detectors) and all signals set to "stop," "not clear," or the like. In various embodiments, the method 300 may be repeated for plural test modes, with each test mode having associated therewith a particular authorization condition.

Figure 4:
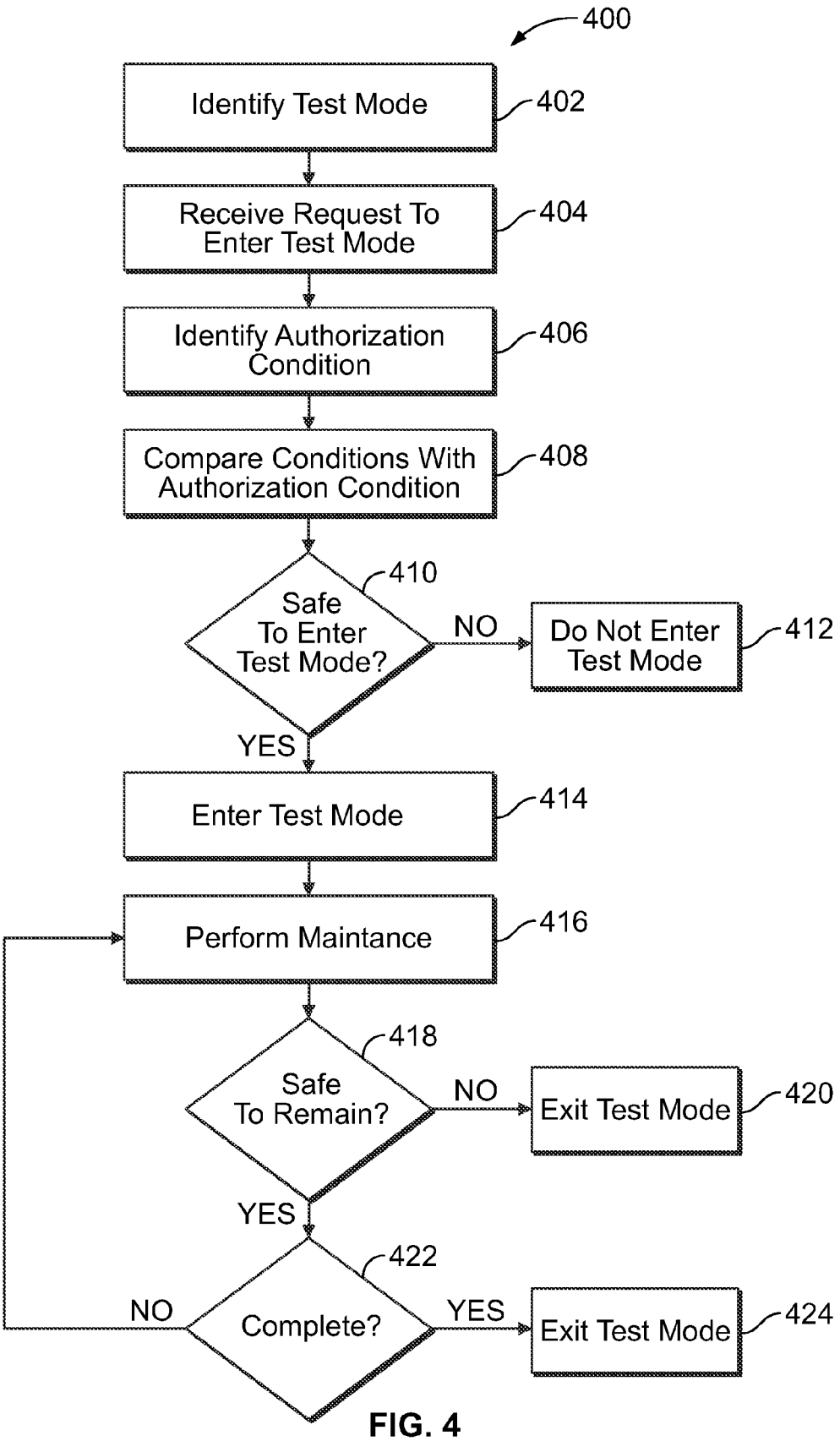
FIG. 4 is a flowchart of one embodiment for maintaining an interlocking.

FIG. 4 is a flowchart of one embodiment for performing maintenance on or troubleshooting an interlocking. The method 400 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 402, a test mode is identified. For example, a particular element or aspect (e.g., a device or devices) of a transportation network may be functioning in an undesirable manner, and may be identified for maintenance, inspection, troubleshooting, or the like. A test mode may then be identified for the particular device or devices. The test mode may specify particular inputs to an interlocking controller system corresponding to the device or devices. For example, if a switch is reporting intermittently, one or more inputs or outputs of an interlocking controller system corresponding to the switch may be specified for the identified test mode.

At 404, an interlocking control system receives a request to enter the test mode identified at 402. For example, a wayside station or unit may include or be operably connectable to a user input module. Maintenance personnel may enter or otherwise specify a test mode for a particular maintenance or troubleshooting activity. The test mode may specify one or more inputs or outputs of the interlocking control system to be varied from values associated with an operational mode of the interlocking where the interlocking and associated components are operating pursuant to an intended operation (e.g., an operation of the system as designed for standard operation of the transportation network).

At 406, an authorization condition corresponding to the test mode requested at 404 is identified. As one example, the authorization condition in some embodiments may be specified by a requester. As another example, in some embodiments, the authorization condition may be autonomously selected by the interlocking control system, for example using a database or application program correlating test modes with corresponding authorization conditions. The authorization condition, for example, may correspond to one or more statuses of various elements of a transportation network. For example, in one example scenario, a test mode requested may correspond to a variation of settings of a switch. However, if the settings of the switch, as seen by the interlocking control system, are changed from an operational value when a vehicle is in the vicinity of the switch, the vehicle may incorrectly be controlled to traverse over the switch, which may result in a derailment. Hence, the authorization condition may be specified to prevent any variation in the status of the switch as seen by the interlocking control system when a vehicle is within a given range and/or is approaching the switch. Thus, in various embodiments, the authorization condition may include signal information (e.g., a setting for appropriate signals that a portion of the route may not be entered) and/or occupancy information (e.g., an indication of whether or not any vehicles are near the switch or are scheduled to pass over the switch).

At 408, the interlocking control system compares the conditions of the transportation network with the authorization condition. For example, one or more of information obtained from a detector describing the condition of a switch, information from a detector describing occupancy of a portion of a route, information from a signal describing the status of the signal, information from a vehicle regarding the location and/or speed of the vehicle, information from a dispatch center regarding the location (and/or future location) of one or more vehicles, or the like may be used to identify the state of one or more elements of a transportation network. For example, the state of one or more signals may be "not clear," and the occupancy state of a portion of a network may be unoccupied.

At 410, it is determined if it is safe to enter the test mode. In various embodiments, an authorization bit or variable may be set to a first value if, based on the comparison at 408, the pertinent conditions of the transportation network match the authorization conditions, and the authorization bit or variable may be set to a second value if the pertinent conditions do not match the authorization conditions. If the conditions match (e.g., the authorization variable is set to the first value), it may be determined that it is safe to enter the test mode and the method 400 proceeds to 414. For example, the authorization condition may require that a given portion of a route be unoccupied and that one or more corresponding signals have a "not clear" or "do not enter" status. If the given portion of the route is indeed determined to be unoccupied and all pertinent signals have the appropriate status, it may be determined safe to enter the test mode. If the conditions do not match (e.g., the authorization variable is set to the second value), it may be determined that it is not safe to enter the test mode and the method 400 proceeds to 412.

At 412, with the authorization condition not satisfied, the test mode is not entered. In various embodiments, maintenance personnel may be provided with an indication (e.g., a light display, audible indication, or the like) that the test mode was not entered. In some embodiments, a reason for the refusal of entry into a test mode (e.g., "track occupied," "signal with improper status," or the like) may be displayed to the maintenance personnel.

At 414, with the authorization condition satisfied, the test mode is entered. In some embodiments, entry into the test mode may be accomplished by a specified alteration of one or more inputs or outputs from the operational mode. In other embodiments, entry into the test mode may allow various alterations to one or more inputs or outputs. For example, a display screen of a user request module may display the inputs or outputs available for alternation, and maintenance personnel may be allowed to select which inputs or outputs are changed as well as to specify values for the inputs or outputs to change. For example, a switch may be transmitting an out of alignment status to the interlocking control system. In a test mode, the input from the switch may be changed to "normal" or "reverse" from the out of alignment status to help troubleshoot any issues related to the switch.

At 416, maintenance is performed using the test mode. For example, one or more values of inputs or outputs may be altered, and the results observed. The results may be observed by observing values of corresponding outputs, and/or observing physical behavior of one or more functional activity modules, and/or observing statuses or displays of one or more signals. In various embodiments, a number of alterations to different inputs or outputs may be made sequentially. For example, a guide displayed to maintenance personnel by an interlocking control system or by a unit operably connected to the interlocking control system may provide suggestions, step-by step guidance, or the like to maintenance personnel performing a troubleshooting or maintenance procedure.

At 418, it is determined if it is safe to remain in the test mode. For example, an authorization bit or variable set based on conditions may be evaluated periodically (e.g., at predetermined time intervals). If the conditions of the transportation continue to match (e.g., the authorization variable is set to the first value), it may be determined that it is safe to remain in the test mode and the method 400 proceeds to 422. If the conditions do not match (e.g., the authorization variable is set to the second value), it may be determined that it is not safe to remain in the test mode and the method 400 proceeds to 420.

At 420, with the authorization condition no longer satisfied, the test mode may be exited and the operational mode re-entered. In various embodiments, maintenance personnel may be provided with an indication (e.g., a light display, audible indication, or the like) that the test mode was revoked. In some embodiments, a reason for the revocation of the test mode (e.g., "track occupied," "signal with improper status," or the like) may be displayed to the maintenance.

At 422, with the authorization condition satisfied, it is determined if maintenance is complete. If the troubleshooting or maintenance activity is complete, the method may proceed to 424, and the test mode exited (e.g., the system returns to the operational mode). If it is determined that maintenance is not complete (e.g., further maintenance or troubleshooting activity is required or desired, the method 400 may return to 416.

In one embodiment, a system includes a detection module, a control module, and a determination module. The detection module is configured to obtain information from one or more detectors corresponding to at least one of a condition or status of a transportation network. The control module is configured to issue control messages to at least one vehicle using the information obtained from the detection module when the control module is operating in an operational mode. The control module is configured to receive a request for the control module to enter a test mode. The test mode corresponds to an alteration of at least one of an input or an output of the control module from the operational mode. The at least one of the input or the output corresponds to a status or setting of a functional activity module of the transportation network. The determination module is configured to determine if an authorization condition associated with the test mode is satisfied. The authorization condition corresponds to a state of one or more elements of a transportation network corresponding to the system. The control module is configured to, responsive to receipt of the request, enter the test mode if the authorization condition is satisfied and to continue operating in the operational mode if the authorization condition is not satisfied.

In one aspect, the determination module is configured to periodically determine if the authorization condition remains satisfied after an initial determination that the authorization condition is satisfied. In various embodiments, the control module may be configured to transfer from the test mode to the operational mode if the authorization condition does not remain satisfied.

In one aspect, the state to which the authorization condition corresponds and the at least of the input or the output of the control module associated with the test mode are user programmable.

In one aspect, the determination module is configured to select the authorization condition from plural authorization conditions. Each of the plural authorization conditions correspond to a respective test mode, and the determination module is configured to select the authorization condition based on the test mode which the control module was requested to enter.

In one aspect, the alteration of at least one of the input or the output of the control module includes an alteration of a status of a rail switch. For example, the authorization condition may include a signal condition and an occupancy condition. In various embodiments, the signal condition corresponds to a signal being set in a stop condition and the occupancy condition corresponds to a predetermined route portion having no vehicles disposed thereon.

An embodiment relates to a method that includes receiving, at one or more processing units of a wayside system associated with a control system for controlling a vehicle traversing a transportation network, a request for the control system to enter a test mode. The test mode corresponds to an alteration of at least one of an input or an output of a control module of the control system from an operational mode. The at least one of the input or the output correspond to a status or setting of a functional activity module of the transportation network. The method also includes determining, at the one or more processors, if an authorization condition associated with the test mode is satisfied. The authorization condition corresponds to a state of one or more elements of the transportation network corresponding to the wayside system. Also, the method includes transferring, responsive to the request, the control system to the test mode if the authorization condition is satisfied, and continuing operation of the control system in the operational mode if the authorization condition is not satisfied.

In an embodiment of the method, the method includes periodically determining if the authorization condition remains satisfied after an initial determination that the authorization condition is satisfied. In various embodiments, the method may further include transferring the control system from the test mode to the operation mode if the authorization condition does not remain satisfied.

In an embodiment of the method, the method includes selecting the authorization condition from plural authorization conditions. Each of the plural authorization conditions correspond to a respective test mode, and the selecting the authorization condition is performed based on the test mode which the control system was requested to enter.

In an embodiment of the method, the alteration of at least one of the input or the output of the control module includes an alteration of a status of a switch. In various embodiments, the authorization condition may include a signal condition and an occupancy condition.

In an embodiment, a tangible and non-transitory computer readable medium includes one or more computer software modules configured to direct one or more processors to receive a request for a control system to enter a test mode, the test mode corresponding to an alteration of at least one of an input or an output of a control module of the control system from an operational mode, the at least one of the input or the output corresponding to a status or setting of a functional activity module of a transportation network; determine if an authorization condition (e.g., an authorization condition corresponding to a state of one or more elements of a transportation network) associated with the test mode is satisfied; transfer, responsive to the request, the control system to the test mode if the authorization condition is satisfied; and continuing operation of the control system in the operational mode if the authorization condition is not satisfied.

In one aspect, the computer readable medium is further configured to direct the one or more processors to periodically determine if the authorization condition remains satisfied after an initial determination that the authorization condition is satisfied. In various embodiments, the computer readable medium is further configured to direct the one or more processors to transfer the control system from the test mode to the operational mode if the authorization condition does not remain satisfied.

In one aspect, the computer readable medium is further configured to direct the one or more processors to select the authorization condition from plural authorization conditions. Each of the plural authorization conditions corresponds to a respective test mode, and the one or more processors are configured to select the authorization condition based on the test mode which the control module was requested to enter.

In one aspect, the alteration of at least one of the input or the output of the control module includes an alteration of a status of a switch. In various embodiments, the authorization condition may include a signal condition and an occupancy condition.

In an embodiment, a system includes a detection module, a control module, and a determination module. The detection module is configured to obtain information from one or more detectors relating to a transportation network. The control module is configured to issue control messages to at least one vehicle using the information obtained from the detection module when the control module is operating in an operational mode. The control module is also configured to receive a request for the control module to enter a test mode. The determination module is configured to determine if an authorization condition associated with the test mode is satisfied. The authorization condition corresponds to a state of the transportation network. Responsive to receipt of the request, the control module is configured to enter the test mode if the authorization condition is satisfied and the control module is configured to continue operating in the operational mode if the authorization condition is not satisfied.

In an embodiment, a system includes a wayside control module configured, when operating in an operational mode, to issue control messages to at least one vehicle based on information obtained about a status of a transportation network in which the vehicle travels. The wayside control module is further configured, responsive to a request to enter a test mode of operation of the control module, to enter the test mode if an authorization condition of the test mode is satisfied and to continue operating in the operational mode if the authorization condition is not satisfied.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

a detection module configured to obtain information from one or more detectors corresponding to at least one of a condition or status of a transportation network;

a control module configured to issue control messages to at least one vehicle using the information obtained from the detection module when the control module is operating in an operational mode, the control module also configured to receive a request for the control module to enter a test mode, the test mode corresponding to an alteration of at least one of an input or an output of the control module from the operational mode, the at least one of the input or the output corresponding to at least one of a status or setting of a functional activity module of the transportation network; and a determination module configured to determine if an authorization condition associated with the test mode is satisfied, the authorization condition comprising an occupancy condition representative of a portion of a route that is determined to be unoccupied by one or more vehicles within a predetermined range or ranges of one or more elements of the transportation network, wherein responsive to receipt of the request, the control module is configured to enter the test mode if the authorization condition is satisfied and the control module is configured to continue operating in the operational mode if the authorization condition is not satisfied, and wherein the occupancy condition is determined based on information provided by a track detection system of the transportation network.

2. The system of claim 1, wherein the determination module is configured to periodically determine if the authorization condition remains satisfied after an initial determination that the authorization condition is satisfied.

3. The system of claim 2, wherein the control module is configured to transfer from the test mode to the operational mode when the authorization condition at least one of does not remain satisfied or expires.

4. The system of claim 1, wherein the authorization condition and the at least one of the input or the output of the control module associated with the test mode are user programmable.

5. The system of claim 1, wherein the determination module is configured to select the authorization condition from plural authorization conditions, each of the plural authorization conditions corresponding to a different respective test mode, wherein the determination module is configured to select the authorization condition based on the test mode which the control module was requested to enter, wherein each of the different test modes includes a specification of one or more particular alterations of the at least one of the input or the output of the control module.

6. The system of claim 1, wherein the alteration of at least one of the input or the output of the control module comprises an alteration of a status of a rail switch.

7. The system of claim 6, wherein the authorization condition comprises a signal condition.

8. The system of claim 1, wherein the signal condition corresponds to a signal being set in a stop condition and the occupancy condition corresponds to a predetermined route portion having no vehicles disposed thereon.

9. The system of claim 1, wherein the control module is different than the functional activity module.

10. A method comprising:

receiving, at one or more processing units of a wayside system associated with a control system for controlling a vehicle traversing a transportation network, a request for the control system to enter a test mode, the test mode corresponding to an alteration of at least one of an input or an output of a control module of the control system from an operational mode, the at least one of the input or the output corresponding to at least one of a status or setting of a functional activity module of the transportation network;

determining, at the one or more processing units, if an authorization condition associated with the test mode is satisfied, the authorization condition comprising an occupancy condition representative of a portion of the route that is unoccupied by one or more vehicles within a predetermined range or ranges of one or more elements of the transportation network corresponding to the wayside system;

transferring, responsive to the receiving the request, the control system to the test mode if the authorization condition is satisfied, wherein the occupancy condition is determined based on information provided by a track detection system of the transportation network; and continuing operating the control system in the operational mode if the authorization condition is not satisfied.

11. The method of claim 10, further comprising periodically determining if the authorization condition remains satisfied after an initial determination that the authorization condition is satisfied.

12. The method of claim 11, further comprising transferring the control system from the test mode to the operational mode if the authorization condition at least one of does not remain satisfied or expires.

13. The method of claim 10, further comprising selecting the authorization condition from plural authorization conditions, each of the plural authorization conditions corresponding to a different respective test mode, wherein the selecting the authorization condition is performed based on the test mode which the control system was requested to enter, wherein each of the different test modes includes a specification of one or more particular alterations of the at least one of the input or the output of the control module.

14. The method of claim 10, wherein the alteration of at least one of the input or the output of the control module comprises an alteration of a status of a rail switch.

15. The method of claim 14, wherein the authorization condition comprises a signal condition.

16. The method of claim 10, wherein the control module is different than the functional activity module.

17. A tangible and non-transitory computer readable medium comprising one or more computer software modules configured to direct one or more processors to:

receive a request for a control system to enter a test mode, the test mode corresponding to an alteration of at least one of an input or an output of a control module of the control system from an operational mode, the at least one of the input or the output corresponding to at least one of a status or setting of a functional activity module of a transportation network;

determine if an authorization condition associated with the test mode is satisfied, the authorization condition comprising an occupancy condition representative of a portion of a route that is unoccupied by one or more vehicles within a predetermined range or ranges of one or more elements of the transportation network;

transfer, responsive to the request, the control system to the test mode if the authorization condition is satisfied, wherein the occupancy condition is determined based on information provided by a track detection system of the transportation network; and continue operating the control system in the operational mode if the authorization condition is not satisfied.

18. The computer readable medium of claim 17, wherein the computer readable medium is further configured to direct the one or more processors to periodically determine if the authorization condition remains satisfied after an initial determination that the authorization condition is satisfied.

19. The computer readable medium of claim 18, wherein the computer readable medium is further configured to direct the one or more processors to transfer the control system from the test mode to the operational mode if the authorization condition at least one of does not remain satisfied or expires.

20. The computer readable medium of claim 17, wherein the computer readable medium is further configured to direct the one or more processors to select the authorization condition from plural authorization conditions, each of the plural authorization conditions corresponding to a different respective test mode, wherein the one or more processors are configured to select the authorization condition based on the test mode which the control module was requested to enter, wherein each of the different test modes includes a specification of one or more particular alterations of the at least one of the input or the output of the control module.

21. The computer readable medium of claim 17, wherein the alteration of at least one of the input or the output of the control module comprises an alteration of a status of a rail switch.

22. The computer readable medium of claim 21, wherein the authorization condition comprises a signal condition.

23. The computer readable medium of claim 17, wherein the control module is different than the functional activity module.

* * * * *